US005833765A

United States Patent [19]

Flynn et al.

[11] Patent Number: 5,833,765

[45] Date of Patent: Nov. 10, 1998

[54] ENGINE CONDITIONING APPARATUS AND METHOD

[76] Inventors: Robert E. Flynn; Robert A. Flynn, both of 5112 Heintz St., Baldwin Park, Calif. 91706

[21] Appl. No.: 547,730

[22] Filed: Oct. 26, 1995

Related U.S. Application Data

[63] Continuation-in-part of Ser. No. 435,281, May 5, 1995, abandoned, which is a continuation of Ser. No. 125,417, Sep. 22, 1993, abandoned.

[51] Int. Cl.[6] ..... B08B 9/02

[52] U.S. Cl. ..... 134/22.12; 134/22.18; 134/166 C; 134/169 A; 134/166 R; 123/198 A

[58] Field of Search ..... 134/167 R, 166 R, 134/57 R, 56 R, 113, 169 A, 22.12, 22.18, 169 R; 123/198 A

[56] References Cited

U.S. PATENT DOCUMENTS

| | | | |
|---|---|---|---|
| 4,059,123 | 11/1977 | Bartos et al. | 134/169 A |
| 4,083,399 | 4/1978 | Babish et al. | 134/169 A |
| 4,671,230 | 6/1987 | Turnipseed | 123/198 A |
| 4,791,890 | 12/1988 | Miles et al. | 134/169 A |
| 4,877,043 | 10/1989 | Carmichael et al. | 134/169 A |
| 4,977,872 | 12/1990 | Hartopp | 134/169 A |
| 4,989,561 | 2/1991 | Hein et al. | 134/169 A |
| 5,022,364 | 6/1991 | Phillips | 123/198 A |
| 5,063,896 | 11/1991 | Hyatt et al. | 134/169 A |
| 5,289,837 | 3/1994 | Betancourt | 134/57 R |
| 5,337,708 | 8/1994 | Chen | 134/169 A |

*Primary Examiner*—Frankie L. Stinson
*Attorney, Agent, or Firm*—Boniard I. Brown

[57] ABSTRACT

Carbon deposits and related residue are removed from he internal surfaces of components of an internal combustion engine, particularly the fuel ports of a carbureted engine and the injection nozzles of a fuel injection engine, by circulating an engine conditioning fuel, through the engine utilizing a conditioning fuel pump, preferably driven by a fluid driven motor, for pumping conditioning fuel to the engine. The conditioning apparatus can detect leakage of the fuel pressure regulator of a fuel injected engine and can operate in both a one-line mode in which conditioning fuel flows one way from the apparatus to the engine and a two-line mode wherein the conditioning fuel is recirculated through the engine and conditioning apparatus. A preferred embodiment provides diagnostic features for checking the conditioning apparatus and certain engine components. These include a by-pass conduit between a flowmeter input side and an engine pressure regulator, check valve means to test opening pressure of the pressure regulator, a pressure control valve to restrict flow to reduce pressure below a set pressure regulator opening pressure to indicate leakage, a shut-off valve closable to provide indication of static system pressure produced by the engine fuel pump, and openable to provide indication of flow rate produced by the fuel pump.

36 Claims, 6 Drawing Sheets

ENGINE CONDITIONING APPARATUS AND METHOD

RELATED APPLICATIONS

This application is a continuation-in-part of application Ser. No. 08/435,281, filed May 5, 1995, now abandoned, which is a continuation of Ser. No. 08/125,417, filed September 22, 1993,now abandoned.

Reference is made to U.S. Pat. No. 5,287,834 entitled Method and Apparatus For Cleaning Deposits and Residue From Internal Combustion Engines, and U.S. Pat. No. 5,271,361 entitled Engine Conditioning Method and Apparatus.

BACKGROUND OF THE INVENTION

1. Field of the Invention

This invention relates generally to the art of servicing internal combustion engines and more particularly to an improved engine conditioning apparatus for cleaning internal carbon deposits from an internal combustion engine.

2. Prior Art

This invention, much like those disclosed in the above referenced patents, is concerned with curing certain well known operating problems associated with internal combustion engines, including fuel injected engines, carbureted engines, diesel engines, and turbines. One of these problems resides in the fact that during engine operation, deposits of carbon and related residue and contaminants, collectively referred to herein simply as carbon deposits, form on the internal engine surfaces including, particularly, the internal carburetor fuel port surfaces of carbureted engines and the internal fuel injector surfaces of fuel injected engines. Unless removed at regular intervals, these carbon deposits may build up sufficiently to seriously degrade engine performance and possibly even totally clog at least the relatively small carburetor and fuel injector passages.

Various engine conditioning procedures and systems have been devised for removing such internal carbon deposits. One known procedure, for example, involves circulating a carbon cleaning fluid through the engine. The following patents describe this procedure in which a combustible carbon cleaning fuel is circulated through an engine to simultaneously power and clean the engine: U.S. Pat. No. 4,787,348, dated Nov. 29, 1988, to Taylor, and U.S. Pat. No. 4,977,872, dated Dec. 18, 1990, to Hartopp. Another engine cleaning procedure is essentially a hand procedure which involves disassembling an engine and individually cleaning the engine parts. While this hand cleaning procedure is obviously relatively complex, time consuming and costly and requires the services of highly skilled personnel, it provides two distinct advantages over the cleaning fluid circulating procedure described in the above patents. These advantages are highly effective cleaning of engine parts and accurate and reliable determination of engine cleanliness by direct visual inspection of the cleaned engine parts.

Another problem involved in the conditioning of certain internal combustion engines, particularly diesel engines and other fuel injected engines, is loss of prime. Loss of prime prevents starting of the engines and occurs as a result of air entering into the engine fuel lines during connection of engine conditioning apparatus to and disconnection of the conditioning apparatus from the engines.

U.S. Pat. Nos. 5,287,834 and 5,271,361 referred to earlier disclose improved engine conditioning systems of the class which clean internal carbon deposits from an engine by circulating a carbon cleaning fluid or fuel through the engine. Simply stated, these engine conditioning systems have a conditioning fluid tank for containing the carbon cleaning fluid or fuel, an output or delivery line for connecting the conditioning tank to the fuel input means (i.e., carburetor, fuel injectors) of the engine to be cleaned through which fuel is introduced into the engine combustion chambers during normal engine operation, an excess fuel return line for connecting the tank to the excess fuel return means of the engine through which unused fuel is recycled from the fuel input means back to the engine fuel tank during normal engine operation, and a pump for pumping the carbon cleaning fluid or fuel from the conditioning tank through the delivery line. The pump of the conditioning apparatus is driven by an electrical motor. The delivery line and excess fuel return line of the conditioning systems have quick disconnect couplings at their ends for connecting these lines to the fuel input means and excess fuel return means of the engine.

The engine conditioning system disclosed in U.S. Pat. No. 5,271,361 includes a by-pass connecting the conditioning fuel tank and conditioning fuel delivery line in parallel with the conditioning fuel pump, and a check valve in this by-pass which permits flow through the bypass only in a direction from the tank to the delivery line. During engine cleaning operation of the engine, the by-pass check valve remains closed during operation of the conditioning fuel pump until the engine starts, whereupon the engine fuel pump commences to pump the conditioning fuel through the conditioning system and engine, and the by-pass check valve opens to by-pass the conditioning fuel pump.

SUMMARY OF THE INVENTION

This invention provides an improved engine conditioning apparatus of the class which cleans internal carbon deposits from an engine by circulating a combustible carbon cleaning fluid or fuel through the engine. The improved conditioning apparatus of the invention provides several major improvements which involve (a) elimination of a fire hazard which exists in the prior engine conditioning systems referred to above, (b) provision of a by-pass/purge valve for permitting emergency engine shut-down and avoiding fuel spray from couplings during disconnection of the conditioning apparatus from the engine being cleaned, (c) detection of opening, closing, and leakage of the pressure regulator of a fuel injected engine, (d) engine conditioning utilizing either a one-line or two-line hookup of the conditioning apparatus to the engine and at either low or high conditioning fluid pressure, and (e) tamper-resistant operation of the conditioning fuel pump.

The improved engine conditioning apparatus of this invention, like those of the aforementioned U.S. Pat. Nos. 5,287,834 and 5,271,361, comprises a conditioning fluid tank for containing an engine conditioning fluid, that is a combustible carbon cleaning fluid or fuel, a cleaning fluid delivery line for connecting the conditioning tank to the fuel input means (i.e., carburetor, fuel injectors) of the engine to be cleaned, an excess fuel return line for connecting the tank to the excess fuel return means of the engine, and a pump for pumping the conditioning fluid or fuel from the conditioning tank through the delivery line. During engine cleaning operation of the improved conditioning apparatus, conditioning fluid is pumped from the conditioning tank to the engine fuel input means through the conditioning fluid delivery line and is introduced into the engine combustion chamber means while the engine is being cranked.

The conditioning fluid is combustible in the engine combustion chamber means so that during engine cleaning operation of the engine conditioning apparatus, the engine starts and continues to run on the conditioning fluid in much the same manner as it does on conventional fuel during normal engine operation. Excess or unused fuel is returned from the engine fuel input means to the conditioning tank through the excess fuel return line of the conditioning apparatus. The preferred engine conditioning apparatus of the invention includes a by-pass connecting the conditioning fuel tank and the conditioning fluid delivery line in parallel with the conditioning fluid pump and a check valve in the passage for by-passing the latter pump when the engine fuel is operated by the engine to pump the conditioning fluid during engine cleaning operation.

According to one important feature of the invention, the conditioning fuel pump of the conditioning apparatus is driven by a fluid-powered motor rather than an electrical motor as are the fuel pumps of the prior engine conditioning systems referred to earlier. The fuel pump motor is connected to a remote source of motor driving fluid, such as high pressure air, through a fluid supply line having a quick disconnect coupling at its end to connection to the source. The improved conditioning apparatus thus embodies no electrical elements and thereby avoids the fire hazard which exists in the prior conditioning systems because of their inclusion of electrical pump motors and other electrical devices.

According to another important feature of the invention, the conditioning apparatus includes a combination purge and emergency engine shut-off valve. This valve is normally closed during normal engine cleaning operation of the conditioning apparatus and may be opened when disconnecting the conditioning apparatus from the engine at the conclusion of the engine cleaning operation to purge fuel pressure from the engine and conditioning apparatus at the conclusion of the engine cleaning operation to prevent fuel from spraying from the fluid delivery and excess fuel return line couplings when the apparatus is disconnected from the engine. The shut-off valve may also be opened to cut off conditioning fluid flow to and thereby stop the engine during the engine cleaning operation in the event of a fuel leak or other emergency during engine cleaning.

Another feature of the invention resides in a unique flowmeter arrangement in the engine conditioning apparatus which may be used to detect leakage of the pressure regulator of a fuel injected engine. This flowmeter may also be used to determine opening and closing of the pressure regulator in connection with high and low pressure operation of the conditioning apparatus.

According to a further feature of the invention, the engine conditioning apparatus may be operated with only the conditioning fluid delivery line connected to the engine (referred to herein as one-line operation) or with both the delivery line and the excess fluid return line connected to the engine (referred to herein as two-line operation). The conditioning apparatus may also be operated at a relatively low conditioning fluid pressure to the engine (referred to herein as low pressure operation) or a high conditioning fluid pressure to the engine (referred to herein as high pressure operation), all depending upon the condition of the engine to be cleaned.

According to yet a further feature of the invention, driving fluid is supplied to the fluid-driven motor of the conditioning fluid pump through a pressure regulator which is set at a desired driving fluid pressure and locked by tamper resistant means to avoid damage to the conditioning apparatus by excessive driving fluid pressure. Other features and advantages of the improved engine conditioning apparatus will appear as the description proceeds.

A preferred embodiment of the invention provides diagnostic features for checking the engine conditioning apparatus and the engine. A diagnostic by-pass conduit is provided between the flowmeter input side and the vehicle pressure regulator. A shut-off valve closable to block flow through the system to provide indication by the pressure gauge of static pressure produced by the engine fuel pump is openable for flowmeter indication of flow rate produced by the vehicle fuel pump, as well as indication of any flow restriction in the system. Valve means are closable to block flow from the engine pressure regulator, with the engine not operating and with high pressure, to detect leakage in the fuel handling system. A pressure control valve is operable for progressive restriction of flow to the engine to reduce system pressure below the set opening pressure of the pressure regulator to provide flowmeter indication of pressure regulator leakage by indicating flow at such lower pressure.

DESCRIPTION OF THE PREFERRED EMBODIMENTS

Figure 1:
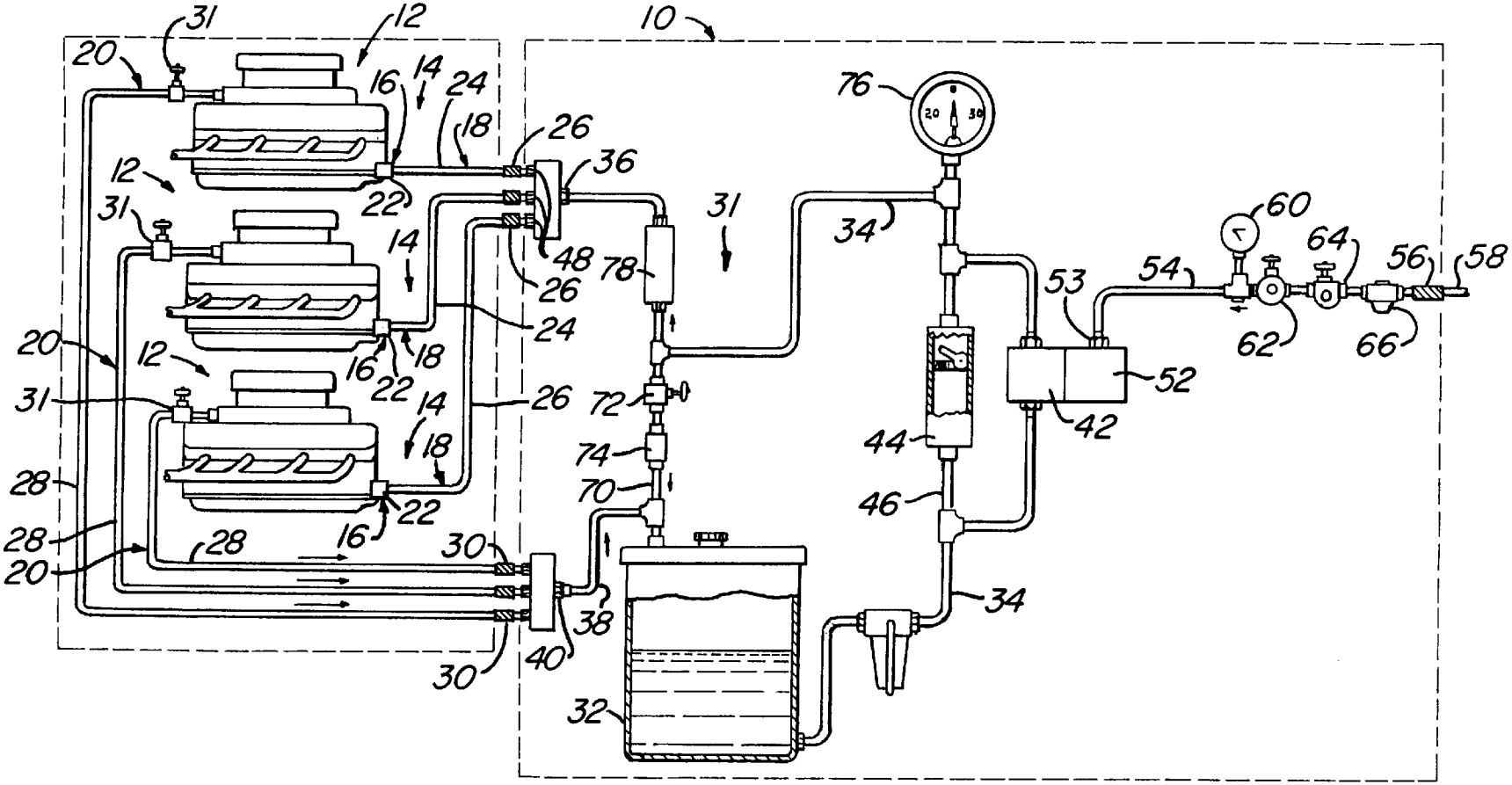
FIG. 1 illustrates an improved engine conditioning apparatus according to the invention connected to three internal combustion engines to be cleaned which may be fuel injected gasoline engines, diesel engines or carbureted engines.

Turning now to these drawings and first to FIG. 1, there is illustrated an improved engine conditioning apparatus 10 according to the invention connected to three internal combustion engines 12 to be cleaned. The three engines are identical and may be carbureted engines, fuel injected gasoline engines or diesel engines. The engines illustrated are conventional diesel engines and thus need not be described in detail. Suffice it to say that each engine includes a fuel system 14 for supplying fuel to the engine and recycling excess fuel from the engine during normal engine operation. This fuel system includes fuel input means 16 for introducing fuel into the engine combustion chambers (not shown), fuel infeed means 18 for supplying fuel to the fuel input means 16, and excess fuel return means 20 for conducting unused fuel from the engine. The fuel input means 16 includes fuel injectors (not shown) for injecting fuel into the engine combustion chambers and a fuel supply pump 22 for feeding fuel to the injectors under pressure. The fuel infeed means 18 comprises a fuel supply line 24 having a coupling 26 at its end which, during normal engine operation, connects to a fuel line (not shown) leading to the engine fuel tank (not shown). The excess fuel return means 20 comprises an excess fuel return line 28 having a coupling 30 at its end which, during normal engine operation, connects to a fuel line (not shown) leading to the engine fuel tank and to the engine fuel supply pump 22. Each excess fuel return line contains an adjustable flow restriction valve 31.

During normal operation of each engine 12, its fuel input means 16 receives fuel from the engine fuel tank and introduces most of the fuel into the engine combustion chambers through the engine fuel injectors to power the engine. The remaining excess or unused fuel is utilized to cool and lubricate the fuel injectors and is returned to the fuel tank and to the fuel input means through the excess fuel return line 28.

The improved engine conditioning apparatus 10 of this invention is similar in many respects to and has certain structure in common with the engine conditioning apparatus disclosed in the earlier mentioned U.S. Pat. No. 5,271,361. The structure of the conditioning apparatus 10 common to that of this patent comprises a conditioning fluid handling system 31 including (a) a conditioning fuel tank 32 for containing a combustible carbon cleaning fluid (hereafter referred to as an engine conditioning fuel or simply conditioning fuel), (b) a conditioning fluid delivery line 34 having one end connected to the tank 32 and an opposite outlet end 36 for connection to the engine fuel infeed means 16, (c) an excess fuel return line 38 having one end connected to the tank 32 and an opposite inlet end 40 for connection to the engine excess fuel return means 20, (d) a conditioning fuel pump 42 for pumping conditioning fuel from the tank 32 through the delivery line 34, and (e) a check valve 44 which provides a by-pass flow path 46 connected between the tank 32 and the delivery line 34 in parallel with the conditioning fuel pump 42 and permits conditioning fuel flow through the parallel by pass flow path only in a direction from the tank 32 to the delivery line. On the outlet end 36 of the delivery line 34 is a coupling manifold having quick disconnect couplings 48 for connection to the couplings 26 on the engine fuel supply lines 24. On the inlet end 40 of excess fuel return line 38 is a coupling manifold having quick disconnect couplings 50 for connection to the couplings 30 on the engine excess fuel return lines 28.

During engine cleaning operation of the engine cleaning apparatus 10, the end 36 of the conditioning fuel delivery line 34 is connected to the engine fuel infeed means 18 by connecting the delivery line couplings 48 to the engine fuel supply line couplings 26. The end 40 of the excess fuel return line 38 is connected to the engine excess fuel return means 20 by connecting the return line couplings 50 to the engine excess fuel return line couplings 30. The conditioning fuel tank 32 is filled with a desired quantity of the conditioning fuel to be used for cleaning carbon deposits from the engines 12. The conditioning fuel pump 42 is operated to feed engine conditioning fuel from the tank 32 to the engine fuel infeed means during cranking of the engines. The conditioning fuel is injected into and combusted within the engine combustion chambers to start the engines. During this cranking of the engines, the pump creates a pressure differential across the check valve 44 which closes the valve so that the conditioning fuel output from the pump is delivered to the engines 12 through the conditioning fuel delivery line 34. When the engines start, their fuel supply pumps 22 commence pumping the conditioning fuel to the engines, and the conditioning fuel pump 42 is stopped. The by-pass check valve 44 then opens to by-pass the pump 42.

During this operation of the engines 12 when connected to the conditioning apparatus 10, conditioning fuel passes from the conditioning fuel tank 32 through and cleans internal carbon deposits from, the engine fuel system 14 and fuel input means 16. Unused conditioning fuel emerging from the engines through their excess fuel return lines 28 is returned to the conditioning fuel tank 32 for recirculation to the engines. The engine cleaning operation is timed by the timer of FIG. 5 to be described presently. According to a preferred feature of the invention, the conditioning fuel tank 32 is transparent to permit visual observation of the conditioning fuel level in the tank in order to avoid complete emptying of the tank during the engine cleaning operation.

According to another important improvement feature of this invention, the conditioning fuel pump 42 is driven by a fluid-driven motor 52. The preferred pump motor is an air-driven motor. Connected at one end to the fluid inlet 53 of the pump motor is a fluid supply line 54 having a quick disconnect 56 at its other end for connection to a source of driving fluid for the pump motor. In FIG. 1, for example, the fluid supply line coupling 56 is connected to a high pressure air hose 58 leading to a high pressure air source (not shown). This feature of the invention is highly important for the reason that it eliminates the acute fire hazard presented by the electrical pump motors of the prior engine conditioning systems which are located in very close proximity to the fuel handling portions of the prior systems and thus present the risk of initiating a fire by arcing of the motors. This feature of the present invention permits the fuel handling conditioning apparatus to be located at a very safe distance from any electrical devices, such as an electrically-driven air compressor.

According to a further feature of the invention, the fluid supply line 54 to the pump motor contains a pressure gauge 60, an adjustable flow regulating valve 62, a shutoff valve 64, and a tamper-proof pressure regulating valve 66. The pressure regulating valve 66 is set at the factory to limit the maximum operating fluid pressure to the fuel pump motor 52 to a pressure level below that which would cause damage to the motor and below that which would result in driving of the conditioning fuel pump 42 at speed sufficiently high to produce excessive conditioning fuel pressure in the engine fuel systems. After the pressure regulating valve 66 is thus set, it is fixed against adjustment by the operator of the conditioning apparatus.

According to a further important improvement feature of the invention, the fluid handling means 31 of the engine conditioning apparatus 10 includes means 68 providing a flow path 70 connecting the conditioning fuel delivery line 34 between its outlet end 36 and the conditioning fuel pump 42 to the top of the conditioning fuel tank 32 and to the excess fuel return line 38. The parallel flow path means 70 includes a shutoff valve 72 and a check valve 74. The shutoff valve 72 is normally closed, and serves as a combination purge valve and emergency engine shut-down valve. The check valve 66 permits flow through the parallel flow path 62 only in a direction from the delivery line 34 to the tank 32 and excess fuel return line 38.

The purge/emergency engine shut-down valve 72 remains closed during normal engine cleaning operation of the engine conditioning apparatus 10 so that conditioning fuel flow through the fuel handling system 31 occurs from the conditioning fuel tank 32 through the conditioning fuel pump 42 or by-pass check valve 44 and fuel delivery line 34 to the engines 12, excess fuel flow from the engines occurs through the excess fuel return line 38 back to the tank 32. At the conclusion of the cleaning operation, the valve 72 is bled to the conditioning fuel tank 32 and any fuel pressure which exists in the engine fuel systems 14 and the apparatus fuel handling system 31 so as to avoid fuel spraying from the couplings 48, 50 of the conditioning apparatus when the couplings are disconnected from the engines 12. In the event of an emergency during an engine cleaning operation, such as a fuel leak in one of the engines or at one of the several couplings 26/49 or 30/50, the valve 72 may be opened to stop the engines 12. In this regard, it will be understood that opening the valve 72 cuts off fuel flow to engines from the conditioning fuel tank 32 and thus stops the engines. Connected in the conditioning fuel handling system 31 are a pressure gauge 76 and flowmeter 78 for indicating the fuel pressure in and fuel flow through the system.

Figure 2:
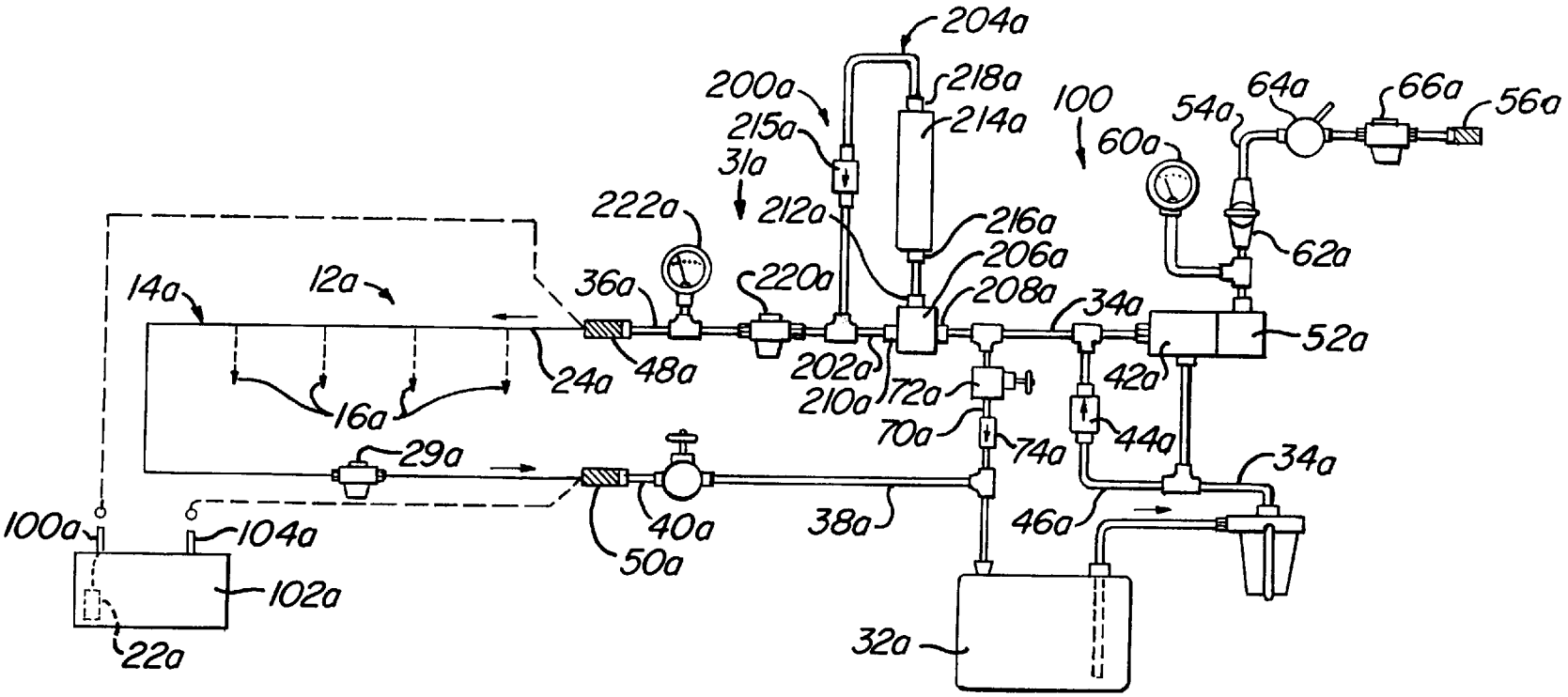
FIG. 2 illustrates a modified engine conditioning apparatus according to the invention connected to a fuel injected engine to be cleaned which may be either a fuel injected gasoline engine or a turbine engine.
Figure 3:
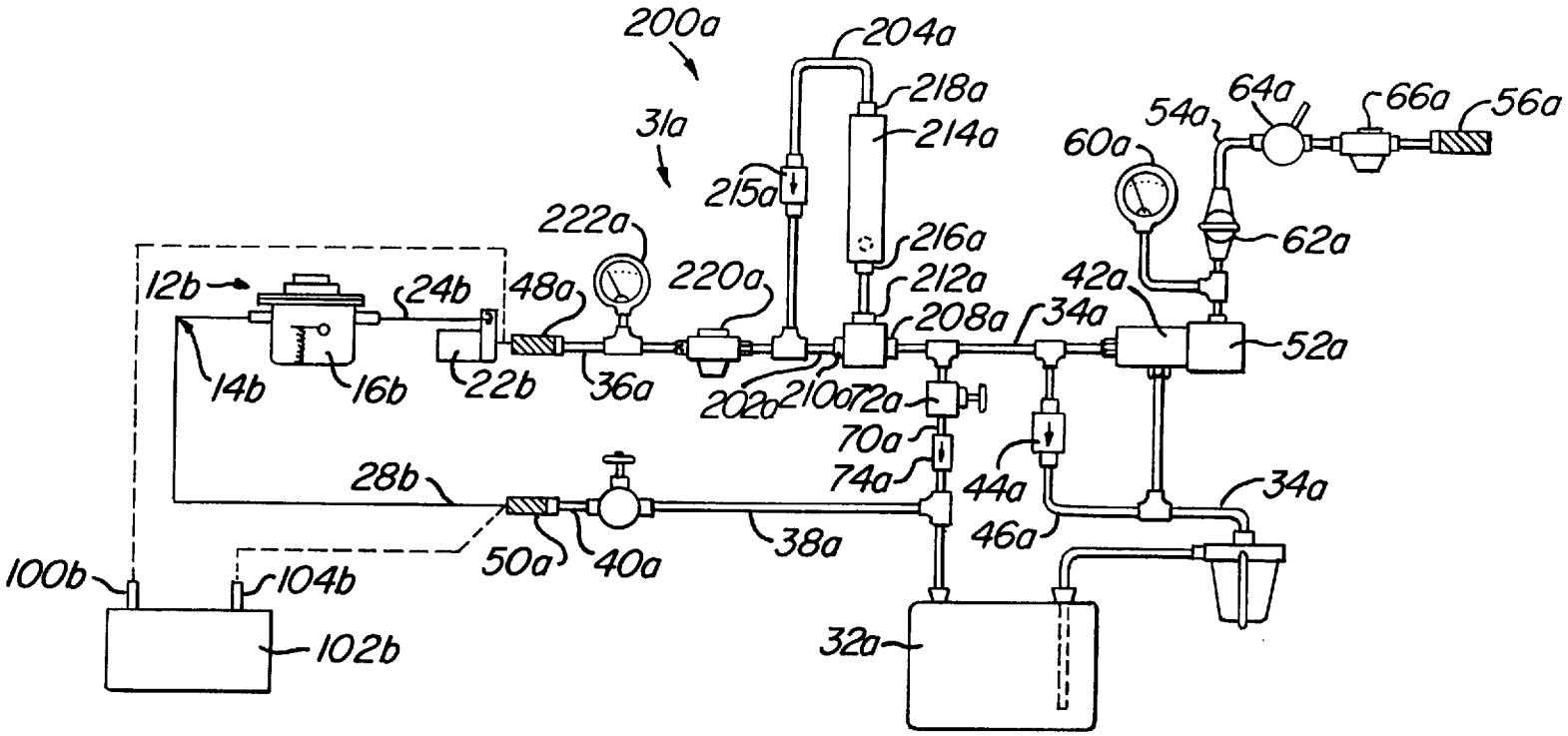
FIG. 3 illustrates a further modified engine conditioning apparatus according to the invention connected to a carbureted engine.
Figure 4:
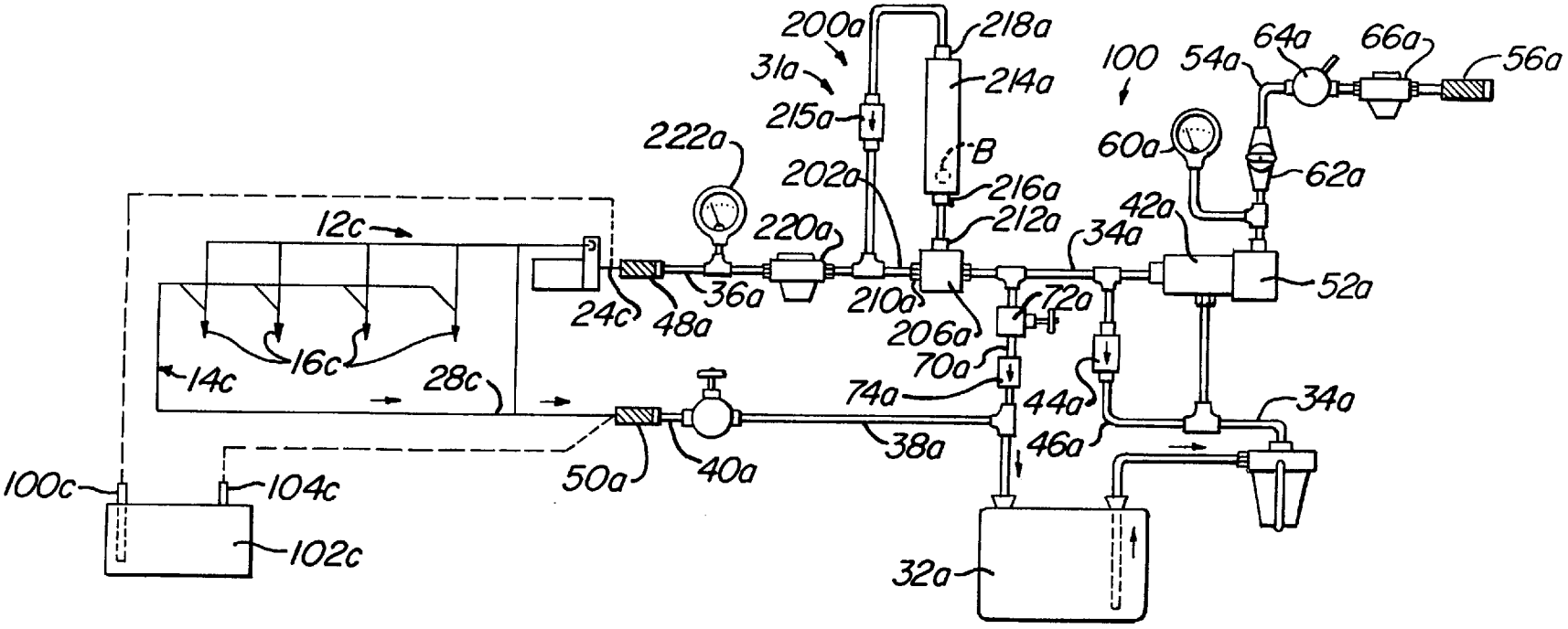
FIG. 4 illustrates a further modified engine conditioning apparatus according to the invention connected to a fuel injected engine which may be a diesel engine or a turbine engine.

FIGS. 2–4 illustrate a modified engine conditioning apparatus 10*a* according to the invention connected to a gasoline fuel injected engine 12*a* (FIG. 2), a carbureted engine 12*b* (FIG. 3) and a diesel or turbine engine 12*c* (FIG. 4). The engine conditioning apparatus 10*a* is identical in many respects to the engine conditioning apparatus 10 of FIG. 1. For this reason the parts of the conditioning apparatus 10*a* which are common to both the latter apparatus and the conditioning apparatus 10 are designated by the same reference numerals, with the suffix "a" as the corresponding parts of the conditioning apparatus 10. Also the parts of the engines 12*a*, 12*b*, 12*c* illustrated in FIGS. 2–4 are designated by the same reference numerals, with the suffix "a", "b", or "c", as the case may be.

Thus engine 12*a* has a fuel system 14*a* including fuel input means 16*a* (fuel injectors), a fuel infeed line 24*a*, and an excess fuel return line 28*a* containing a fuel pressure regulator 29*a*. During normal engine operation, the fuel infeed line 24*a* is connected to a fuel supply line 100*a* from an engine fuel pump 22*a* positioned within the engine fuel tank 102*a*, and the excess fuel return line 28*a* connects to a fuel return line 104*a* to the engine fuel tank, as indicated in broken lines in FIG. 2.

Engine 12*b* has a fuel system 14*b* including fuel input means 16*b* (carburetor), a fuel infeed line 24*b* containing an engine fuel pump 22*b*, and an excess fuel return line 28*b*. During normal engine operation, the fuel infeed line 24*b* is connected to a fuel supply line 100*b* from the engine fuel tank 102*b*, and the excess fuel return line 28*b* connects to a fuel return line 104*b* to the engine fuel tank, as shown in broken lines in FIG. 3.

Engine 12*c* has a fuel system 14*c* including fuel input means 16*c* (fuel injectors), a fuel infeed line 24*c* containing an engine fuel pump 22*c*, and an excess fuel return line 28*c*. During normal engine operation, the fuel infeed line 24*c* is connected to a fuel supply line 100*c* from the engine fuel tank 102*c*, and the excess fuel return line 28*c* connects to a fuel return line 104*c* to the engine fuel tank, as shown in broken lines in FIG. 4.

The modified engine conditioning apparatus 10*a*, includes a conditioning fluid handling system 31*a* including (a) a conditioning fuel tank 32*a* for containing a combustible carbon cleaning fluid, (b) a conditioning fluid delivery line 34*a* having one end connected to the tank 32*a* and an opposite outlet end 36*a* for connection to the engine fuel infeed line 24*a*, 24*b*, 24*c*, as the case may be, (c) an excess fuel return line 38*a* having one end connected to the tank 32*a* and an opposite inlet end 40*a* for connection to the engine excess fuel return line 28*a*, 28*b*, or 28*c*, as the case may be, (d) a conditioning fuel pump 42*a* for pumping conditioning fuel from the tank 32*a* through the delivery line 34*a*, and (e) a check valve 44*a* which provides a by-pass flow path 46*a* connected between the tank 32*a* and the delivery line 34*a* in parallel with the conditioning fuel pump 42*a* and permits conditioning fuel flow through the parallel by-pass flow path only in a direction from the tank 32*a* to the delivery line. On the outlet end 36*a* of the delivery line 34*a* is a quick disconnect coupling 48*a* for connection to the coupling on the engine fuel supply line 24*a*, 24*b*, 24*c*, as the case may be. On the inlet end 40*a* of excess fuel return line 38*a* is a quick disconnect coupling 50*a* for connection to the coupling on the engine excess fuel return line 28*a*, 28*b*, 28*c*. The outlet and inlet ends 36*a*, 40*a* of the delivery line 34*a* and return line 38*a* may mount coupling manifolds like those in FIG. 1 to permit connection of the modified engine conditioning apparatus to several engines.

Connected to the conditioning fluid delivery line 34*a* between the conditioning fuel pump 42*a* and the outlet end 36*a* of the line and to the conditioning fuel tank 32*a* and the excess fuel return line 38*a* is a purge/emergency engine shut-down valve 72*a* and check valve 74*a* which provide a flow path 70*a* between the delivery line and the fuel tank 32 and return line 38*a*. The conditioning fuel pump 4*a* is driven by a fluid-driven motor 52*a* which is supplied with driving fluid through a fluid supply line 54*a* containing a pressure gauge 60*a*, a flow control valve 62*a*, shutoff valve 64*a*, a preset tamper-proof pressure regulator 66*a*, and a quick disconnect coupling 56*a* for connection to a source of motor driving fluid.

As thus far described, the engine conditioning apparatus 10*a* is essentially identical to and operates in essentially the same manner as described earlier in connection with the engine conditioning apparatus 10. During cleaning of the engines by operation of the engine conditioning apparatus 10*a*, however, the engine fuel tank lines 100*a*, 104*a*, 100*b*, 104*b*, 100*c*, 104 are disconnected from their engines and hence these fuel lines have open ends. These open fuel line ends should be plugged to prevent draining of engine fuel from the lines and, in the case of engine 12*a*, to prevent its fuel pump 22*a* from pumping fuel from the engine fuel tank 102*a* through the open fuel line 100*a* in the event the pump continues to run during cleaning of the engine 12*a* by the conditioning apparatus 10*a*.

The engine conditioning apparatus 10*a* includes selectable flow path means 200*a* connected in the conditioning fuel delivery line 34*a* between the outlets of the conditioning fuel pump 42*a* and by-pass check valve 74*a* and the outlet end 36*a* of the delivery line. This flow path means provides two parallel flow paths 202*a*, 204*a*, and includes a selector valve 206*a* for selecting either flow path. The selector valve 206*a* has an inlet 208*a*, two outlets 210*a*, 212*a*, and selectively operable valve means (not shown) for selectively connecting the valve inlet to either valve outlet. The valve inlet 208*a* connects to the outlets of the conditioning fluid pump 42*a* and the by-pass check valve 74*a*. The selector valve outlet 210*a* connects to the fuel delivery line 34*a* down stream of the selector valve through a portion of the delivery line which forms the selectable flow path 202*a*. The selector valve outlet 212*a* connects to the fuel delivery line 34*a* at the juncture of this line and the flow path 202*a* through the selectable flow path 204*a*.

Flow path 204*a* contains a flowmeter or flow gauge 214*a* and a check valve 215*a*. Flowmeter 214*a* has an inlet 216*a* which connects to the selector valve outlet 212*a* and an outlet 218*a* which connects to the fuel delivery line 34*a* at the juncture of this line and the flow path 202*a*. The check valve 215*a* permits flow through the flow path 204*a* only in a direction from the flowmeter inlet 216*a* to the flowmeter outlet 218*a*. The conditioning apparatus 10 *a* also includes an adjustable needle valve 220*a* and a pressure gauge 222*a* in the fuel delivery line 34*a* downstream of the selectable flow path means 200*a*.

During operation of the engine conditioning apparatus 10*a*, the selector valve 206*a* may be set to direct conditioning fuel through either flow path 202*a*, 204*a* to the engine(s) being cleaned. The selector valve 206*a* is normally set to direct the conditioning fuel through the flow path 202*a* so as to by-pass the flowmeter because of the undesirable restriction which the flowmeter imposes on fluid passing through the meter. This is particularly true when cleaning several engines at a time. In this regard, it will be recalled from the earlier description that while FIGS. 2–4 illustrate the engine conditioning apparatus 10*a* connected to a single engine, the apparatus may be used to condition several engines at a time in the same manner as the engine conditioning apparatus of FIG. 1. By-passing the flowmeter 214*a* is particularly important when cleaningengines siengines simultaneously, because of the substantially greater conditioning fuel flow required than when cleaning a single engine. Whenever it is desirable or necessary to do so, the conditioning fluid flow to the engine(s) being cleaned may be measured by setting the selector valve 206*a* to direct the conditioning fluid through the flow path 204*a* so that fuel flow to the engines occurs through the flowmeter 214*a*. A typical flowmeter for use in the apparatus has a ball B which remains stationary in a certain normal position on its seat until flow occurs through the meter at a certain minimum threshold flow rate and which commences to "float" upwardly from its seat in response to flow through the meter and at a flow rate above the threshold flow rate.

When cleaning a fuel injected engine 12*a*, the flowmeter 214*a* may also be used to determine or detect when the engine pressure regulator 29*a* cracks open. To this end, the check valve 215*a* in the flow path 204*a* of the engine conditioning apparatus 10*a* is one which not only permits fluid flow only in the direction indicated but also is adjustable to crack open in the direction of flow only in response to a pressure differential across the valve at least equal to a certain minimum threshold pressure differential. The check valve progressively opens more in proportion to an increasing pressure differential above this threshold differential. The flowmeter thus imposes a back pressure on the flowmeter. In order to detect when the engine pressure regulator 29*a* opens, the flowmeter check valve 214*a* is set so that when the fuel pressure to the engine (as indicated on the pressure gauge 222*a*) is just slightly below the rated cracking pressure of the engine pressure regulator 29*a*, so that the regulator is closed, the check valve 214*a* opens just sufficiently to supply the engine fuel injection nozzles 16*a* without floating the flowmeter ball B from its seat. When the engine pressure regulator 29*a* cracks open in response to an increase in the fuel pressure to the engine, the flow through the flowmeter 214*a* increases and causes the flowmeter ball to float upwardly from its seat. In a typical fuel injected engine, the pressure regulator 29*a* will open at about 40 psi, and the flowmeter check valve 214*a* will be set to open in response to an opening force of about 1½ pounds.

The flowmeter 214*a* may be utilized to check for leakage of the engine pressure regulator 29*a* of a fuel injected engine. To check for leakage of the pressure regulator, the flowmeter check valve 215*a* is set as discussed above based on the rated or design cracking pressure of the engine pressure regulator. If the pressure regulator 29*a* does not leak, the flowmeter ball B will not float above its seat. If the pressure regulator 29*a* does leak, the flowmeter ball B will float above its seat. Thus, leakage of the pressure regulator will be indicated by floating of the flowmeter ball B above its seat.

As indicated earlier, the engine conditioning apparatus of the invention can be utilized in either a one line operating mode or a two line operating mode and in either a low pressure operating mode or a high pressure operating mode. Two line operation of the engine conditioning apparatus is accomplished by connecting both the conditioning fuel delivery line 34, 34*a* and the fuel return line 38, 38*a* to the engine(s) to be cleaned in the manner described thus far. One line operation is accomplished by connecting only the conditioning fuel delivery line 34, 34*a* to the engine(s) and performing one of the following additional procedures: (a) plugging or otherwise blocking fuel return flow through the engine excess fuel return line(s) 38, 38*a*,or (b) adjusting the conditioning fuel pressure to the engine(s), by adjusting the air valve 62, 62*a* to adjust the speed of the conditioning fuel pump 42, 42*a* or adjusting the apparatus fuel pressure regulator 220*a*, to a pressure level to the engine slightly below that at which the engine pressure regulator 29*a* opens in the case of a fuel injected engine 12*a* (utilizing the flowmeter 214*a* in the manner described above to determine when the pressure regulator is about to crack open). In this single line operation of the engine conditioning apparatus, then, all of the conditioning fuel delivered to the engine(s) being cleaned flows through the engine fuel input means into the engine combustion chambers.

Low pressure operation of the engine conditioning apparatus 10, 10*a* involves operating the apparatus at a relatively low fuel pressure (on the order of 39 psi) to the engine being cleaned. In the case of the fuel injected engine 12*a* this relatively low fuel pressure would be a fuel pressure just slightly below the cracking pressure (about 40 psi) of the engine fuel pressure regulator 29*a*. Here again, the flowmeter 214*a* can be used in the manner described above to determine when the pressure regulator is about to crack open. High pressure operation of the conditioning apparatus involves operating the apparatus at a relatively high fuel pressure (on the order of 60 psi) to the engine.

Figure 5:
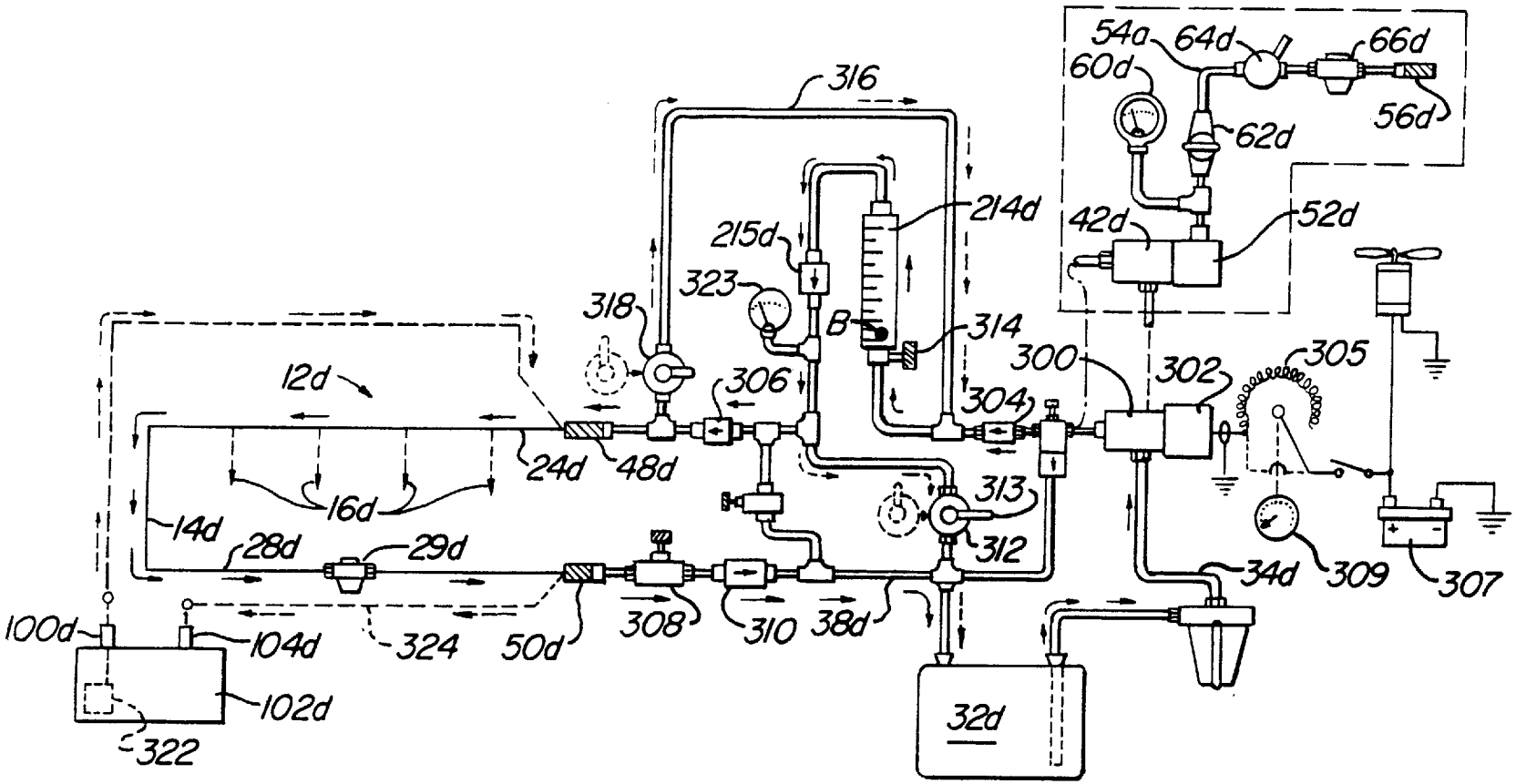
FIGS. 5 and 6 illustrate an embodiment of the engine conditioning apparatus of the present invention adapted for diagnostic checking of the conditioning apparatus and engine system components, FIG. 5 showing the apparatus in a diagnostic mode of operation and FIG. 6 showing the apparatus in an engine conditioning mode of operation.
Figure 6:
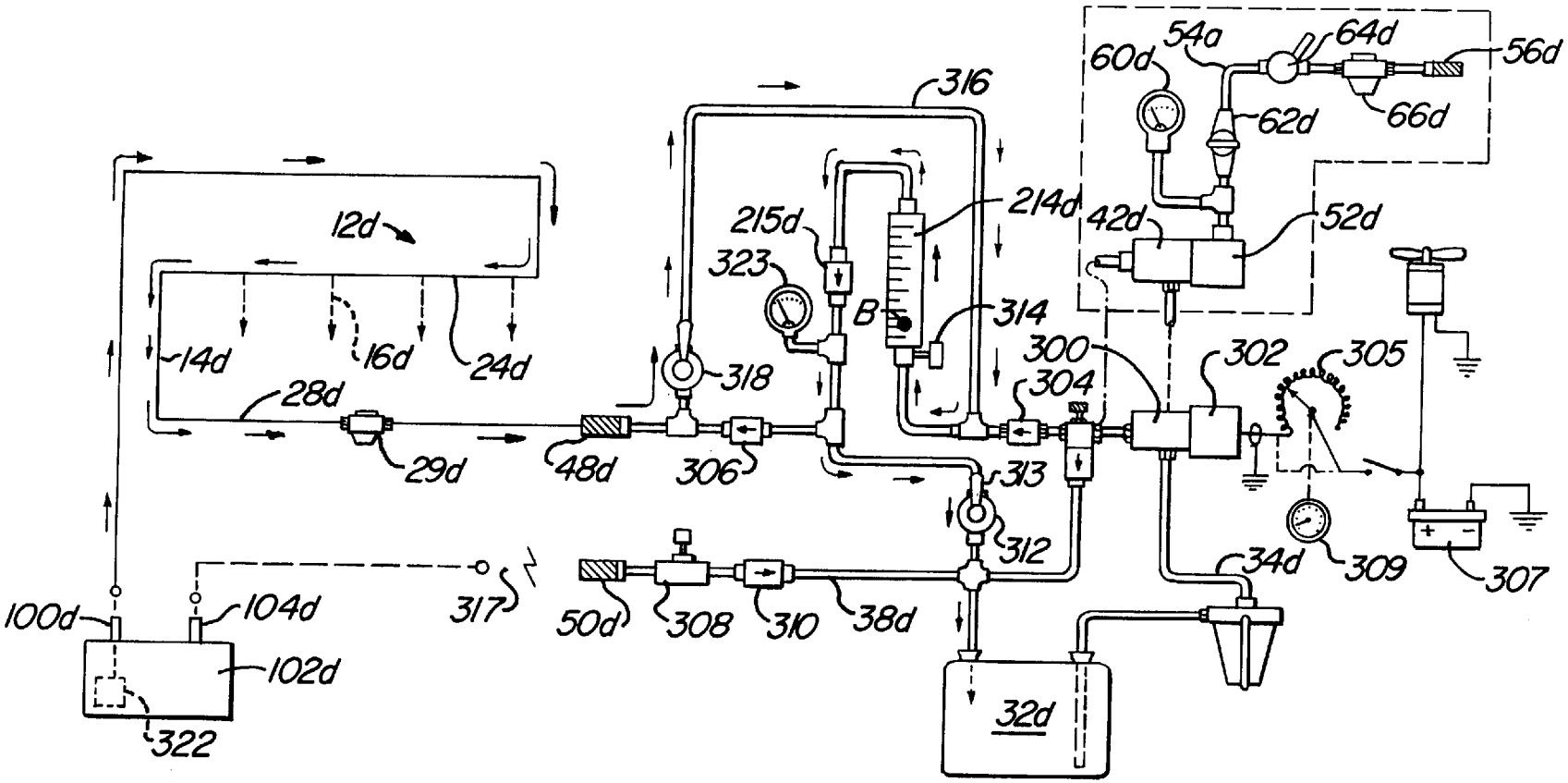

The overall operation of the engine conditioning apparatus of the invention is now obvious from the foregoing description. The conditioning apparatus is connected to an engine during cleaning of the engine and is then disconnected from the engine when the cleaning operation is completed. The conditioning fuel is initially pumped from the conditioning fuel tank 32, 32*a* through the engine by operating the air valve 62, 62*a* to supply operating air to the motor 52, 52*a* for driving the conditioning fuel pump 42, 42*a*. The air valve is adjustable to vary the pump speed and thereby the rate of conditioning fuel flow to the engine. After the engine starts, operation of the conditioning fuel pump 42, 42*a* may be continued in the event that the engine fuel pump is deactivated, as by cutting off the supply of electrical power for driving the fuel pump 22*a* of the fuel injected engine 12*a*, or the conditioning fuel pump may be stopped, in which case conditioning fuel flow occurs through the by-pass 70,70*a* of the conditioning apparatus. FIGS. 5 and 6 illustrate improved embodiments of the invention which include components and features for diagnosis or diagnostic procedures which can be conveniently and quickly accomplished in connection with utilization of the system according to the invention for cleaning operations. The embodiments of FIGS. 5 and 6 are similar in some respects to the engine conditioning apparatus earlier described. Components and features of the conditioning apparatus which are common to both the earlier apparatus and the apparatus of FIGS. 5 and 6 are designated by the corresponding reference numerals with the suffix "d". The components and features earlier-described are not again described in relation to FIGS. 5 and 6.

The components and system for operation of air motor 42*d* encompassed in broken lines in FIG. 5 are earlier described, and are therefore not re-described. In the operation of the system in a normal cleaning cycle, utilizing the air motor system, pressure may be regulated by adjustment of needle valve 308. This system provides economy by not requiring or utilizing a rheostat, timer, etc., as required for an electric motor operation of a pump motor.

Referring to FIG. 5, an alternate form 300 of conditioning fluid pump 300 is driven by an electric motor 302, the speed of which is governed by a rheostat 305 which is manually controllable and which is provided with a timer 309. The motor may be powered by a battery 307, or by utility electrical power.

In the cleaning cycle of the system utilizing an electric motor 302, rheostat 305 and timer 309, regulation of pressure in the system is controlled by operation of rheostat 305 which governs or controls the speed of electric motor 302 and pump 300.

In FIG. 5, the cleaning cycle is indicated by solid-line arrows, and a pump check cycle is indicated in broken-line arrows.

In the cleaning operation, conditioning fuel passes from the tank 32*d* to clean carbon deposits, etc., from the engine fuel system and fuel input means 16*d*. Unused conditioning fuel to the engine returns via return line 38*d* to the tank 32*d* for recirculation. The engine cleaning operation may be timed by the timer 309 of FIG. 5.

A valve 66*d* of the air-motor 42*d* supply system permits flow in the direction from the delivery line 342*d* to the conditioning fuel tank 32*d*. At the conclusion of the engine cleaning operation, valve 312 is opened to pass to tank 32*d* any fluid in the engine fuel system 142*d* and in the fuel handling system, thus to avoid any spraying of conditioning fuel from couplings 48*d*, 50*d* of the conditioning apparatus when disconnected from the engine 12*d*. To prevent an emergency during cleaning, such as an engine leak or a leak at a coupling, the valve 312 may be operated to shut off the engine.

As indicated by the broken-line arrows (FIG. 5), the cleaning or conditioning flow path for conditioning fuel extends from conditioning fuel tank 32*d*, suction line 34*d* pump 300 (or pump 42*d* as the case may be), thence through check valve 304, flow meter 214*d* check valve 215*d* check valve 306, thence via coupling 48*d* through the engine fuel line 24*d* and through injectors 16*d*, with the excess conditioning fuel passing via line 28*d* pressure regulator 29*d* needle valve 308, check valve 310, the conduits shown, and line 382*d* to the conditioning fuel tank 32*d*.

Each of the check valves 304, 306, 215*d* and 310 is similar, and is commercially available in versions or types to provide appropriate desired flow and restriction. The structure and operation of these valves are therefor not described herein. Check valve 2152*d* is upstream of the pressure gauge 323 and downstream of the flowmeter 214*d*. Check valve 306 is in the flow path from the flowmeter and check valve 2152*d* to the engine. Check valve 215*d* prevents reverse flow through the flowmeter and thence to the system and engine, as when purge valve 312 is open. Check valve 310 in the flow path from the engine and pressure regulator 29*d* prevents purged fuel, with purge valve 312 open, from entering the engine in a reverse direction, the pressure of which could possibly cause reverse flow to the engine to fuel the engine in reverse, thus preventing engine shut-off. Check valve 304 is disposed downstream of conditioning flow pump 300 (or 42*d*), to prevent reverse flow of fluid toward the pump. Check valve 306 prevents cleaning fuel or fluid from passing in a reverse direction through the flowmeter, thus aiding the diagnostic function.

Valves provided for diagnostic purposes include needle valve 314 at the flowmeter 214*d* valve 215*d* downstream of the flowmeter, and check valve 306 downstream of check valve 215*d* in the flow path to the engine being cleaned. Flowmeter 214*d* check valve 306, and needle valves 314 and 308 are operable in the performing of diagnostic steps or functions, which are conveniently and efficiently performed before or during cleaning cycle operation of the system.

A vehicle fuel pump check flow cycle is indicated by solid-line directional arrows in FIG. 6. For this engine pump check cycle, cleaning fuel pump 300 or 42*d* is turned off, the purge or shut-off valve 312 is open, the two-way valve 318 is open, and the flow line between vehicle fuel tank 102*d* and the engine cleaning apparatus is disconnected, as indicated at 317. As indicated by the directional arrows, the pump check cycle flow path extends from the vehicle fuel pump 322 and via lines 24*d*, 28*d* the valve 318, by-pass pump check conduit 316, thence through flowmeter 214*d* check valve 215*d* open purge valve 312, and to the conditioning fuel tank 32*d*.

The purge valve 312 in a flow path to the conditioning fuel tank 32*d*, is shown in solid lines with the handle 313 thereof in closed position, and is shown in phantom outline (FIG. 5) with the handle in open or flow position. The purge and emergency engine shut-down valve 312, when open, and the associated flow line provide a flow path between the delivery line and tank 32*d*.

Diagnostic procedures include a check of the static pressure and flow rate provided to the system by the engine fuel pump 322. The static pressure is determined by closing the purge valve 312 and observing the static pressure indicated by pressure gauge 323. Voluimetric flow is determined by opening the purge valve 312 and observing the flow rate indicated by the flowmeter 214*d* the flowmeter ball indicating flow rate on the flowmeter scale. The volumetric flow rate reading also provides a diagnostic indication as to whether or not there is any flow restriction in the system, a reduced flow rate indicating a restriction, such as a plugged fuel filter.

The engine fuel pressure regulator is set to open at a particular pressure, which may typically be 30 psi, to maintain a fuel pressure of substantially 30 psi during vehicle engine operation at various engine speeds, whether at idle or at relatively high speed and under load conditions. Conventionally, the pressure regulator also serves to maintain a positive leak-tight seal between the engine and the fuel tank to prevent loss of pressure and engine-starting difficulties because of loss of pressure while the vehicle engine is not operating, as when parked overnight.

As indicated earlier, the flowmeter arrangement may be utilized to detect leakage of the pressure regulator of a fuel-injected engine, and to determine the open ng and closing pressures of the pressure regulator, in connection with operation of the conditioning apparatus.

The needle valve 314 is operable to restrict flow through the flowmeter and thus to restrict pressure to the engine. It serves two diagnostic functions. One is to restrict flow to a limited degree into the flowmeter so that the flowmeter ball B does not float and rise while the flowmeter accommodates the quite limited flow needed for the engine input, typically injectors, to effect minimum engine operation.

In the diagnostic procedure for checking the pressure regulator, during engine cleaning, the needle valve 314 is operated by rotation of its control knob to thread it inwardly to restrict fuel flow and to reduce pressure. The flowmeter float B moves progressively lower as flow decreases. If pressure is. reduced so that 25 psi, for example, is indicated at the pressure gauge, and the float is still elevated and floating at such lower pressure, pressure regulator leakage is indicated. There should be no flow at such pressure, because the system should be closed by the pressure regulator at the set pressure, about 30 psi. If the gauge 323 indicates about 30 psi and the flowmeter float drops to its seated position, correct closing pressure of the pressure regulator is indicated.

The check valve 215*d* serves a diagnostic function of indicating the "cracking" opening pressure of the pressure regulator. The valve is preferably adjustable, and is pre-set to "crack" open in the flow direction only in response to a pressure differential across the valve of at least a predetermined minimum differential. The pressure indicated by the pressure gauge upon the opening of the check valve 215*d* indicates the opening pressure of the pressure regulator, and whether it opens at the correct pressure.

Check valve 310 prevents purged fuel from entering the engine in reverse. With the purge valve 312 open, without valve 310, the pressure and fuel pass into tank 32*d*. If the static pressure in the system were to cause fluid to pass in reverse to the engine, the engine thus fueled would not shut off rapidly. Check valve 306 is utilized diagnostically in the pump check cycle. Without this valve, the fuel could pass in reverse direction through the flowmeter. Check valve 304 prevents conditioning fluid from being pumped in reconditioning fueconditioning fuel pump 300 (or 42*d*).

Needle valve 308 is positioned adjacent to check valve 310, upstream of check valve 310, and downstream of the pressure regulator in the flow path from the vehicle engine. It serves to prevent over-pressuring of the system when the regulator is by-passed, and to by-pass and circumvent pressure regulator 29*d*. By closing this valve, there is produced a build-up of pressure in the system to a pressure as high as practically desired. As indicated by the broken-line flow line 324 (FIG. 5), the closing of needle valve 308 in effect by-passes the regulator, removing it from the flow path, and flow passes via line 324 to the engine fuel tank 102*d*. That is, the closing of needle valve 308 effects elimination of the function of pressure regulator 29*d* and causes flow from the regulator to be diverted via flow line 324 to the vehicle fuel tank.

Leak detection in the system is provided by needle valve 308, by shutting off the engine, while leaving about 50–60 psi in the fuel system which is completely closed. Virtually any leak can then be visually detected or detected by the pressure gauge 323. If the pressure gauge begins to lose pressure, a leak somewhere in the system is indicated.

Thus there has been shown and described a novel engine conditioning apparatus and method which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

We claim:

1. Engine conditioning apparatus for cleaning internal carbon deposits from an internal combustion engine having a fuel system including fuel input means through which fuel is introduced into the engine, fuel infeed means for supplying fuel to said fuel input means, and excess fuel return means for conducting said excess fuel from said input means, said conditioning apparatus comprising:

a fuel handling system including a conditioning fuel tank for containing an engine conditioning fuel capable of removing said carbon deposits, a conditioning fuel delivery line including selectable flow path means and having one end for connection to said tank and an opposite end for connection to said engine fuel infeed means, an excess fuel return line having one end connected to said tank and an opposite end for connection to said engine excess fuel return means, and a pump having an inlet connected to said tank and an outlet connected to said one end of said delivery line for pumping conditioning fuel from said tank through said delivery line, means for driving said pump, means providing a first flow path connecting said tank and pump outlet in parallel with said pump and including a check valve which permits flow through said flow path only in a direction from said tank to said delivery line, means providing a second flow path connecting said tank and pump outlet and including a check valve which opens to permit flow through said second path only in the direction of said tank, and a shutoff valve which may be opened to permit fuel flow through said second flow path and closed to block fuel flow through said second flow path, and wherein said selectable flow path means comprises (a) first and second selectable flow paths through which conditioning fuel may flow from said tank to the engine, (b) a selector valve having an inlet connected to said pump outlet, a first outlet connected to said first selectable flow path, a second outlet connected to said second selectable flow path, and means for selectively connecting said valve inlet to either valve outlet, (c) a flow meter in said first selectable flow path having an inlet connected to said first selector valve outlet, and an outlet, and (d) a check valve in said first selectable flow path in series with said flowmeter which opens to permit fuel flow through said first selectable flow path only in a direction from said flowmeter inlet to said flowmeter outlet and in response to a predetermined pressure differential across the last mentioned check valve.

2. Engine conditioning apparatus according to claim 1, wherein:

said means for driving said pump comprises a fluid driven motor having a driving fluid inlet, a fluid supply line having one end connected to said motor inlet and an opposite end for connection to a source of motor driving fluid and a valve in said fluid supply line for controlling driving fluid flow to said motor.

3. Engine conditioning apparatus according to claim 2, including:

a quick disconnect coupling on said opposite end of said delivery line for connection to said engine fuel infeed means, a quick disconnect coupling on said opposite end of said excess fuel return line for connection to said engine excess fuel return means, and a quick disconnect coupling on said opposite end of said fluid supply line for connection to a source of motor driving fluid.

4. In combination:

(a) an internal combustion engine having a fuel system including fuel input means through which fuel is introduced into the engine, fuel infeed means for supplying fuel to said fuel input means, and excess fuel return means for conducting said excess fuel from said input means, and (b) an engine conditioning apparatus for removing internal carbon deposits from said engine, and wherein said conditioning apparatus comprises:

a fuel handling system including a conditioning fuel tank for containing an engine conditioning fuel capable of removing said carbon deposits, a conditioning fuel delivery line including selectable flow path means and having one end for connection to said tank and an opposite end connected to said engine fuel input means, an excess fuel return line having one end connected to said tank and an opposite end connected to said engine excess fuel return means, and a pump having an inlet connected to said tank and an outlet connected to said one end of said delivery line for pumping conditioning fuel from said tank through said delivery line, means for driving said pump, means providing a first flow path connecting said tank and pump outlet in parallel with said pump and including a check valve which permits flow through said flow path only in a direction from said tank to said delivery line, means providing a second flow path connecting said tank and pump outlet and including a check valve which opens to permit flow through said second path only in the direction of said tank, and a shutoff valve which may be opened to permit fuel flow through said second flow path and closed to block fuel flow through said second flow path, and wherein said selectable flow path means comprises (a) first and second selectable flow paths through which conditioning fuel may flow from said tank to the engine, (b) a selector valve having an inlet connected to said pump outlet, a first outlet connected to said first selectable flow path, a second outlet connected to said second selectable flow path, and means for selectively connecting said valve inlet to either valve outlet, (c) a flow meter in said first selectable flow path having an inlet connected to said first selector valve outlet, and an outlet, and (d) a check valve in said first selectable flow path in series with said flowmeter which opens to permit fuel flow through said first selectable flow path only in a direction from said flowmeter inlet to said flowmeter outlet and in response to a predetermined pressure differential across the last mentioned check valve.

5. In combination:

an internal combustion engine having a fuel system for supplying fuel to the engine, and an engine conditioning apparatus for removing internal carbon deposits from the engine, and wherein said conditioning apparatus comprises:

a fuel handling system including a tank for containing a combustible engine conditioning fuel capable of removing internal carbon deposits from the engine, a conditioning fuel delivery line having one end connected to said tank and an opposite end connected to the engine fuel system, and a conditioning fuel pump for effecting conditioning fuel flow from said tank to the engine through said fuel delivery line, a fluid driven motor connected to said pump for driving the pump and having a fluid inlet for receiving a driving fluid for driving said motor, and a fluid supply line having one end connected to said motor inlet, an opposite end for connection to a remote source of said motor driving fluid, and a length which permits placement of said conditioning apparatus at a sufficient distance from said source to prevent accidental ignition of said combustible engine conditioning fuel by any electrical activity associated with said source, wherein said pump has an inlet connected to said tank and an outlet connected to said delivery line, and said apparatus further includes means providing a first flow path connecting said tank and pump outlet and including a check valve which permits flow through said flow path only in the same direction as flow through said pump, and means providing a second flow path connecting said tank and said delivery line and including a check valve which permits flow through said second flow path only in the direction of said tank, and a shut-off valve which can be selectively closed and opened by an operator of the apparatus to selectively block and permit flow through said second flow path.

6. In combination:

(a) an internal combustion engine having a fuel system including fuel input means through which fuel is introduced into the engine, fuel infeed means for supplying fuel to said fuel input means, an engine fuel pressure regulator and excess fuel return means for conducting said excess fuel from said input means, and (b) an engine conditioning apparatus for removing internal carbon deposits from the engine, and wherein said conditioning apparatus comprises:

a fuel handling system including a conditioning fuel tank for containing an engine conditioning fuel capable of removing said carbon deposits, a conditioning fuel delivery line connecting said tank to said engine fuel infeed means, an excess fuel return line connecting said tank to said engine excess fuel return means, and a conditioning fuel pump for effecting conditioning fuel flow from said tank through said fuel delivery line, means providing a flow path connecting said tank and said delivery line and including a check valve which permits flow through said flow path only in the direction of said tank, and a shut-off valve which can be selectively closed and opened by an operator of the apparatus to selectively block and permit flow through said flow path, and a check valve and flowmeter in the flow Path means and adapted to provide indication of opening pressure of said check valve by a pressure gauge downstream of the fuel infeed means to determine correctness of the check valve opening pressure in response to predetermined pressure across the valve.

7.In combination:

(a) a fuel injected internal combustion engine including fuel injectors, a fuel infeed line for conducting fuel to said injectors, a fuel return line for conducting unused fuel from said injectors, and a fuel pressure regulator in said return line, and (b) an engine conditioning apparatus for removing internal carbon deposits from the engine, and wherein said conditioning apparatus comprises:

fuel handling means for conducting an engine conditioning fuel to said engine including first and second parallel flow paths connected to said fuel infeed line, a selector valve for selectively closing either flow path and directing said fuel to the engine through the other flow path, a flowmeter in one flow path for measuring the fuel flow rate though said one flow path, and a normally closed check valve in said one path which opens to permit fuel flow to the engine through said one flow path in response to a predetermined pressure differential across the check valve.

8. A method of operating a fuel injected internal combustion engine having fuel injectors, a fuel infeedl line for conducting fuel to said injectors, a fuel return line for conducting unused fuel from said injectors, and a fuel pressure regulator in said return line having a certain rated cracking pressure at which the regulator is designed to crack open, comprising the steps of:

(a) supplying fuel to said fuel infeed line at a pressure just slightly less than said rated cracking pressure, whereby the fuel flow to said fuel infeed means is injected into the engine through said fuel injectors, and (b) measuring fuel flow to said fuel infeed line with a flow metering means which normally indicates a certain flow rate under the condition set forth in step (a) above, whereby a flow rate indication different from said certain flow rate under the conditions of step (a) indicates leakage of the pressure regulator, and cracking open of the pressure regulator may be determined by gradually increasing the fuel pressure to the engine and noting the change in the flow rate indication of the flow metering means in response to cracking of the regulator.

9. Engine conditioning apparatus for cleaning carbon deposits from an internal combustion engine having a fuel system including fuel input means through which fuel is introduced into the engine, a fuel pump for supplying fuel to said fuel input means, an engine fuel pressure regulator, said conditioning apparatus comprising:

a fuel handling system including a conditioning fuel tank for conditioning fuel capable of removing said carbon deposits, a conditioning fuel delivery line for connecting said tank to said engine fuel infeed means, and a conditioning fuel pump for effecting conditioning fuel flow from said tank through said fuel delivery line, a flow meter and a pressure gauge in the conditioning fuel delivery line to the engine, said conditioning apparatus including a diagnostic by-pass conduit between the input side of the flowmeter and said vehicle pressure regulator, and shut-off valve means downstream of the flow meter, said shut-off valve means being closable to block flow through said fuel handling system to provide indication by said pressure gauge of static fuel system pressure produced by said engine fuel pump, and said shut-off valve means being openable to allow flow through said fuel handling system to provide indication by the flowmeter of flow rate produced by said vehicle fuel pump, and to indicate whether there is flow restriction in the system.

10. An engine conditioning apparatus according to claim 9, wherein said shut-off valve means comprises a manually operable mechanical valve openable for flow of conditioning fuel to the conditioning fuel tank.

11. An engine conditioning apparatus according to claim 9, and further including:

a check valve adjacent to the flowmeter in said fuel delivery line to provide indication by said pressure gauge of the opening cracking pressure of the pressure regulator by the flowmeter to determine correctness of the opening pressure by the check valve opening in the direction of flow in response to a pressure differential across the valve at least equal to a predetermined pressure differential.

12. An engine conditioning apparatus according to claim 9 and further including:

valve means closable to block flow from the engine pressure regulator and divert such flow to the vehicle fuel tank for detection of any leak in the fuel handling system with the engine off and with relatively high pressure in the system, whereby detection of system leakage is observed visually or by pressure drop indication by the pressure gauge.

13. An engine conditioning apparatus according to claim 9 and further including:

a pressure control valve operable to restrict flow to the engine to progressively reduce pressure indicated by said gauge to a lower pressure below the correct set opening cracking pressure of the engine pressure regulator to provide indication by the flowmeter of engine pressure regulator leakage by indicating flow at such lower pressure.

14. An engine conditioning apparatus according to claim 9 and further including excess fuel return means to conduct excess fuel from said fuel input means to the conditioning fuel tank.

15. Engine conditioning apparatus for cleaning carbon deposits from an internal combustion engine having a rueql system including fuel input means through which fuel is introduced into the engine, fuel infeed means for supplying fuel to said fuel input means, an engine fuel pressure regulator, said conditioning apparatus comprising:

a fuel handling system including a conditioning fuel tank for conditioning fuel capable of removing said carbon deposits, a conditioning fuel delivery line for connecting said tank to said engine fuel infeed means, and a conditioning fuel pump for effecting conditioning fuel flow from said tank through said fuel delivery line, a flow meter and a pressure gauge in the conditioning fuel delivery line to the engine, said conditioning apparatus including a diagnostic by-pass conduit between the input side of the flowmeter and said vehicle pressure regulator, and a pressure control valve operable to restrict flow to the engine to progressively reduce pressure indicated by said gauge to a lower pressure below the correct set opening cracking pressure of the engine pressure regulator to provide indication by the flowmeter of engine pressure regulator leakage by indicating flow at such lower pressure.

16. Engine conditioning apparatus according to claim 15, wherein said pressure control valve is a needle valve having a manually operable pressure control knob.

17. An engine conditioning apparatus according to claim 15, and further including:

a check valve adjacent to the flowmeter in said fuel delivery line to provide indication by said pressure gauge of the opening cracking pressure of the pressure regulator by the check valve opening in the direction of flow in response to a pressure differential across the valve at least equal to a predetermined pressure differential.

18. An engine conditioning apparatus according to claim 15, and further including excess fuel return means to conduct excess fuel from said fuel input means to the conditioning fuel tank.

19. An engine conditioning apparatus according to claim 15, and further including:

valve means closable to block flow from the engine pressure regulator and divert such flow to the vehicle fuel tank for detection of any leak in the fuel handling system with the engine off and with relatively high pressure in the system, whereby detection of system leakage is observed visually or by pressure drop indication by the pressure gauge.

20. Engine conditioning apparatus for cleaning carbon deposits from an internal combustion engine having a fuel system including fuel input means through which fuel is introduced into the engine, and fuel pump means for supplying fuel to said fuel input means, an engine fuel pressure regulator, said conditioning apparatus comprising:

a fuel handling system including a conditioning fuel tank for conditioning fuel capable of removing said carbon deposits, a conditioning fuel delivery line for connecting said tank to said engine fuel infeed means, and a conditioning fuel pump for effecting conditioning fuel flow from said tank through said fuel delivery line, a flowmeter and a pressure gauge in the conditioning fuel delivery line to the engine, said conditioning apparatus including a diagnostic by-pass conduit between the input side of the flowmeter and said vehicle pressure regulator, and a check valve adjacent to the flowmeter in said fuel delivery line to provide indication by said pressure gauge of the opening cracking pressure of the pressure regulator by the flowmeter to determine correctness of the opening pressure by the check valve opening in the direction of flow in response to a pressure differential across the valve at least equal to a predetermined pressure differential.

21. An engine conditioning apparatus according to claims 20, wherein said check valve has a predetermined flow restriction according to the cracking opening pressure of the pressure regulator.

22. An engine conditioning apparatus according to claim 20, and further including excess fuel return means to conduct excess fuel from said fuel input means to the conditioning fuel tank.

23. Engine conditioning apparatus for cleaning carbon deposits from an internal combustion engine having a fuel system including fuel input means through which fuel is introduced into the engine, fuel infeed means for supplying fuel to said fuel input means, an engine fuel pressure regulator, said conditioning apparatus comprising:

a fuel handling system including a conditioning fuel tank for conditioning fuel capable of removing said carbon deposits, a conditioning fuel delivery line for connecting said tank to said engine fuel infeed means, and a conditioning fuel pump for effecting conditioning fuel flow from said tank through said fuel delivery line, a flow meter and a pressure gauge in the conditioning fuel delivery line to the engine, said conditioning apparatus including a diagnostic by-pass conduit between the input side of the flowmeter and said vehicle pressure regulator, and valve means closable to block flow from the engine pressure regulator and divert such flow to the vehicle fuel tank for detection of any leak in the fuel handling system with the engine off and with relatively high pressure in the system, whereby detection of system leakage is observed visually or by pressure drop indication by the pressure gauge.

24. An engine conditioning apparatus according to claim 23, and further including:

a pressure control valve operable to restrict flow to the engine to progressively reduce pressure indicated by said gauge to a lower pressure below the correct set opening cracking pressure of the engine pressure regulator to provide indication by the flowmeter of engine pressure regulator leakage by indicating flow at such lower pressure.

25. Engine conditioning apparatus for cleaning carbon deposits from an internal combustion engine having a fuel system for supplying fuel to the engine and an engine fuel pressure regulator, said conditioning apparatus comprising:

a conditioning fuel handling system including a conditioning fuel tank, conditioning fuel flow path means for conducting conditioning fuel from said tank to the engine, and a pump to effect conditioning fuel flow from said tank through said flow path means, said flow path means comprising a flowmeter and a pressure gauge downstream of said pump, and having an inlet connected with said pump, and a check valve adjacent to the flowmeter in said flow path means to provide indication by said pressure gauge of the opening cracking pressure of the pressure regulator by the flowmeter to determine correctness of the opening pressure by the check valve opening in the direction of flow in response to a pressure differential across the valve at least equal to a predetermined threshold pressure differential.

26. Engine conditioning apparatus for cleaning carbon deposits from an internal combustion engine having a fuel system for supplying fuel to the engine and an engine fuel pressure regulator, said conditioning apparatus comprising:

a conditioning fuel handling system including a conditioning fuel tank, conditioning fuel flow path means for conducting conditioning fuel from said tank to the engine, and a pump to effect conditioning fuel flow from said tank through said flow path means, said flow path means comprising a flowmeter and a pressure gauge downstream of said pump, and having an inlet connected with said pump, a check valve adjacent to the flowmeter in said flow path means to provide indication by said pressure gauge of the opening cracking pressure of the pressure regulator by the flowmeter to determine correctness of the opening pressure by the check valve opening in the direction of flow in response to a pressure differential across the valve at least equal to a predetermined threshold pressure differentials and shut-off valve means disposed downstream of the flowmeter, said shut-off valve means being closable to block flow through said fuel handling system to provide indication by said pressure gauge of static fuel system pressure produced by said engine fuel pump, and said shut-off valve means being openable to allow flow through said fuel handling system to provide indication by the flowmeter of flow rate produced by said vehicle fuel pump, and to indicate whether there is flow restriction in the system.

27. Engine conditioning apparatus for cleaning carbon deposits from an internal combustion engine having a fuel system for supplying fuel to the engine and an engine fuel pressure regulator, said conditioning apparatus comprising:

a conditioning fuel handling system including a conditioning fuel tank, conditioning fuel flow path means for conducting conditioning fuel from said tank to the engine, and a pump to effect conditioning fuel flow from said tank through said flow path means, said flow path means comprising a flowmeter and a pressure gauge downstream of said pump, and having an inlet connected with said pump, a check valve adjacent to the flowmeter in said flow path means to provide indication by said pressure gauge of the opening cracking pressure of the pressure regulator by the flowmeter to determine correctness of the opening pressure by the check valve opening in the direction of flow in response to a pressure differential across the valve at least equal to a predetermined threshold pressure differential, and valve means closable to block flow from the engine pressure regulator and divert such flow to the vehicle fuel tank for detection of any leak in the fuel handling system with the engine off and with relatively high pressure in the system, whereby detection of system leakage is observed visually or by pressure drop indication by the pressure gauge.

28. Engine conditioning apparatus for cleaning carbon deposits from an internal combustion engine having a fuel system for supplying fuel to the engine and an engine fuel pressure regulator, said conditioning apparatus comprising:

a conditioning fuel handling system including a conditioning fuel tank, conditioning fuel flow path means for conducting conditioning fuel from said tank to the engine, and a pump to effect conditioning fuel flow from said tank through said flow path means, said flow path means comprising a flowmeter and a pressure gauge downstream of said pump, and having an inlet connected with said pump, and a pressure control valve operable to restrict flow to the engine to progressively reduce pressure indicated by said gauge to a pressure below the correct set opening cracking pressure of the engine pressure regulator to provide indication by the flowmeter of engine pressure regulator leakage by indicating flow at such lowered pressure.

29. Engine conditioning apparatus according to claim 28, wherein said pressure control valve is a needle valve having a manually operable pressure control knob.

30. Engine conditioning apparatus for cleaning carbon deposits from an internal combustion engine having a fuel system for supplying fuel to the engine and an engine fuel pressure regulator, said conditioning apparatus comprising:

a conditioning fuel handling system including a conditioning fuel tank, conditioning fuel flow Path means for conducting conditioning fuel from said tank to the engine, and a pump to effect conditioning fuel flow from said tank through said flow path means, said flow path means comprising a flowmeter and a pressure gauge downstream of said pump, and having an inlet connected with said pump, a check valve adjacent to the flowmeter in said flow path to provide indication by said pressure gauge of the opening cracking pressure of the pressure regulator by the flowmeter to determine correctness of the opening pressure by the check valve opening in the direction of flow in response to a pressure differential across the valve at least equal to a predetermined pressure differential, and a pressure control valve operable to restrict flow to the engine to progressively reduce pressure indicated by said gauge to a pressure below the correct set opening cracking pressure of the engine pressure regulator to provide indication by the flowmeter of engine pressure regulator leakage by indicating flow at such lowered pressure.

31. Engine conditioning apparatus for cleaning carbon deposits from an internal combustion engine having a fuel system for supplying fuel to the engine and an engine fuel pressure regulator, said conditioning apparatus comprising:

a conditioning fuel handling system including a conditioning fuel tank, conditioning fuel flow path means for conducting conditioning fuel from said tank to the engine, and a pump to effect conditioning fuel flow from said tank through said flow path means, said flow path means comprising a flowmeter and a pressure gauge downstream of said pump, and having an inlet connected with said pump, a pressure control valve operable to restrict flow to the engine to progressively reduce pressure indicated by said gauge to a pressure below the correct set opening cracking pressure of the engine pressure regulator to provide indication by the flowmeter of engine pressure regulator leakage by indicating flow at such lowered pressure, and shut-off valve means downstream of the flowmeter, said shut-off valve means being closable to block flow through said fuel handling system to provide indication by said pressure gauge of static fuel system pressure produced by said engine fuel pump, and said shut-off valve means being openable to allow flow through said fuel handling system to provide indication by the flowmeter of flow rate produced by said vehicle fuel pump, and to indicate whether there is flow restriction in the system.

32. Engine conditioning apparatus for cleaning carbon deposits from an internal combustion engine having a fuel system for supplying fuel to the engine and an engine fuel pressure regulator, said conditioning apparatus comprising:

a conditioning fuel handling system including a conditioning fuel tank, conditioning fuel flow path means for conducting conditioning fuel from said tank to the engine, and a pump to effect conditioning fuel flow from said tank through said flow path means, said flow path means comprising a flowmeter and a pressure gauge downstream of said pump, and having an inlet connected with said pump, and shut-off valve means disposed downstream of the flowmeter and upstream of the conditioning fuel tank, said shut-off valve means being closable to block flow through said flow path to provide indication of static fuel system pressure at said pressure gauge, and said shut-off valve means being openable to provide indication by said flowmeter of rate of flow through said flow path to determine whether or not there is flow restriction and whether said pressure regulator is defective.

33. Engine conditioning apparatus according to claim 32, wherein said shut-off valve means comprises a manually operable mechanical valve openable for flow of conditioning fuel to the conditioning fuel tank.

34. An engine conditioning apparatus according to claim 32, and further including:

check valve adjacent to the flowmeter in said flow path line to provide indication by said pressure gauge of the opening cracking pressure of the pressure regulator by the flowmeter to determine correctness of the opening pressure by the check valve opening in the direction of flow in response to a pressure differential across the valve at least equal to a predetermined pressure differential.

35. An engine conditioning apparatus according to claim 32, and further including:

valve means closable to block flow from the engine pressure regulator and divert such flow to the vehicle fuel tank for detection of any leak in the fuel handling system with the engine off and with relatively high pressure in the system, whereby detection of system leakage is observed visually or by pressure drop indication by the pressure gauge.

36. In combination:

(a) an internal combustion engine having a fuel system including fuel input means through which fuel is introduced into the engine, fuel infeed means for supplying fuel to said fuel input means, an engine fuel pressure regulator and excess fuel return means for conducting said excess fuel from said input means, and (b) an engine conditioning apparatus for removing internal carbon deposits from the engine, and wherein said conditioning apparatus comprises:

a fuel handling system including a conditioning fuel tank for containing an engine conditioning fuel capable of removing said carbon deposits, a conditioning fuel delivery line connecting said tank to said engine fuel infeed means, an excess fuel return line connecting said tank to said engine excess fuel return means, and a conditioning fuel pump for effecting conditioning fuel flow from said tank through said fuel delivery line, means providing a flow path connecting said tank and said delivery line and including a check valve which permits flow through said flow path only in the direction of said tank, and a shut-off valve which can be selectively closed and opened by an operator of the apparatus to selectively block and permit flow through said flow path, and a pressure control valve and pressure gauge in said flow path and adapted for reducing pressure to a pressure below a set pressure of said pressure regulator to provide indication by a flowmeter of engine pressure regulator leakage.

* * * * *